United States Patent [19]

Moody

[11] Patent Number: 5,009,182

[45] Date of Patent: Apr. 23, 1991

[54] SUBMARINE TORPEDO TUBE SHUTTERWAY LAUNCH MODE ADAPTER

[75] Inventor: Paul E. Moody, Barrington, R.I.

[73] Assignee: The United States of America as represented by the Secretary of the Navy, Washington, D.C.

[21] Appl. No.: 568,304

[22] Filed: Aug. 15, 1990

[51] Int. Cl.[5] ..... B63G 8/00

[52] U.S. Cl. ..... 114/238; 114/316

[58] Field of Search ..... 114/201 R, 238, 239, 114/312, 316, 320, 335; 277/53, 58, 102; 49/303, 381, 475; 89/1.3, 5, 14.05, 1.809, 1.81, 1.816

[56] References Cited

U.S. PATENT DOCUMENTS

| | | | |
|---|---|---|---|
| 3,379,163 | 4/1968 | Wiethoff | 114/238 |
| 3,395,670 | 8/1968 | Betzold | 114/238 |
| 3,613,640 | 10/1971 | Cohen | 114/335 |
| 3,807,274 | 4/1974 | Cohen | 114/238 |
| 4,848,210 | 7/1989 | Bissonnette | 114/238 |

FOREIGN PATENT DOCUMENTS

| | | | |
|---|---|---|---|
| 107908 | 7/1917 | United Kingdom | 114/320 |

*Primary Examiner*—Sherman D. Basinger
*Assistant Examiner*—Stephen P. Avila
*Attorney, Agent, or Firm*—Michael J. McGowan; Prithvi C. Lall

[57] ABSTRACT

A three-position submarine torpedo tube shutterway that adapts to one of the swimout launch, the ejection launch or the non-launch mode. The shutterway resides within a housing that is located between the muzzleward end of the torpedo tube and an opening in the submarine's hull. The shutterway rotates to accommodate any one of the three modes.

9 Claims, 1 Drawing Sheet

SUBMARINE TORPEDO TUBE SHUTTERWAY LAUNCH MODE ADAPTER

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to a submarine shutterway and more particularly to a submarine torpedo tube shutterway that adapts to both the torpedo swimout and ejection launch modes.

(2) Description of the Prior Art

Existing submarine launch systems have torpedo tubes which are arranged so that their centerlines are canted away from the centerline of the ship at an angle of 10° or less. The torpedo tubes themselves are cylinders having a flat end to accommodate a pressure containing muzzle door. Behind the muzzle door a fired torpedo is guided until it exits the outer hull of the submarine. As a result of the intersecting angle of the torpedo tube and the circularity of the hull itself, the outer door or shutterway is normally quite long in a horizontal direction.

The newest classes of Navy submarines will have torpedo launch tube systems that will be different from existing launch systems in a number of ways. First, the torpedo tubes will be installed with their centerlines parallel to the submarine's centerline in order to allow the launch system to achieve a 0° firing angle with respect to the forward velocity of the submarine. This reduces the number of force vectors acting on the torpedo as it is launched. Secondly, the torpedo tube and its shutterway must be capable of handling two different types of torpedo launches, namely, an ejection launch and a swimout launch.

An ejection launch is one that uses water propulsion to push the torpedo out of the torpedo tube. In such a launch, the torpedo's propellers are not activated until a torpedo clears the hull of the submarine. The water propulsion, or ejection plume as it is known, is applied to the aft end of the torpedo and must be strong enough to push the torpedo through the strong flow field that exists along the boundary layer between the submarine hull and the sea water. Accordingly, in order to support the ejection launch, the torpedo tube and torpedo tube shutterway must only allow the torpedo to pass through while constraining the ejection plume.

A swimout launch is one that uses the propulsion generated by the torpedo's propellers within the torpedo tube. This type of launch is quieter than the aforementioned ejection launch. However, it is also less stable since the velocity generated by a swimout launch is less than the velocity generated by the ejection launch. Thus, the choice of a swimout versus an ejection launch is based upon several factors such as the speed of the submarine and noise considerations. In order for a swimout launch to occur, water must be allowed to flow around the forward end of the torpedo, along its body and into the torpedo's propellers. Accordingly, in order to support a swimout launch, the torpedo tube and torpedo tube shutterway must be large enough to allow the torpedo to pass through and provide a flow area around the torpedo for water to flow into the torpedo's propellers.

SUMMARY OF THE INVENTION

It is therefore an object of the present invention to provide a submarine torpedo tube shutterway that adapts to both an ejection or swimout launch mode.

It is a further object of the present invention to provide a submarine torpedo tube shutterway that creates an acoustic seal with the submarine hull when the torpedo tube is not in the launch mode.

These and other objects and advantages of the present invention will become more apparent hereinafter in the specification and drawings.

The above objects are realized by a three-position shutterway mechanism mounted between the muzzleward end of a torpedo tube and an opening in the hull of the submarine. A first position of the shutterway provides a first passageway between a torpedo tube and submarine hull that is large enough to permit a swimout launch. A second position of the shutterway provides a second passageway between the torpedo tube and submarine hull that is large enough to permit passage of the torpedo but small enough to constrain the ejection plume during an ejection launch. The third position of the shutterway seals both the muzzleward end of the torpedo tube and the opening in the submarine hull. A means for rotating the shutterway to one of its three positions is also provided.

DESCRIPTION OF THE PREFERRED EMBODIMENT

Figure 1:
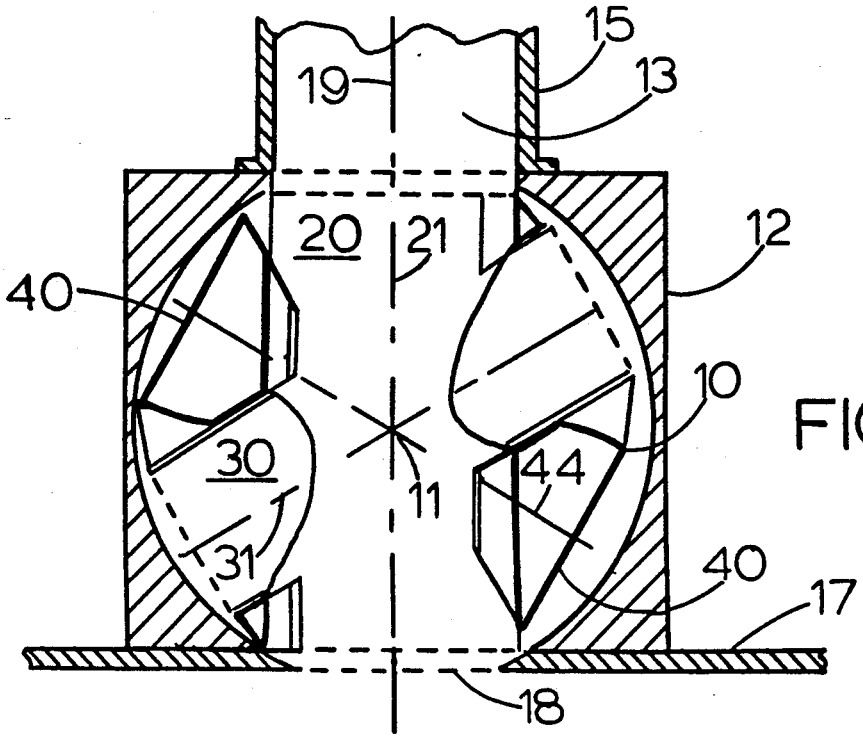
FIG. 1 is a top, cut-away view of the torpedo tube shutterway according to the present invention.

Referring now to the drawings, and in particular to FIG. 1, there is shown a top, cut-away view of the shutterway 10 according to the present invention. The shutterway 10 resides within a housing 12 that is situated between muzzleward end 13 of a cylindrical torpedo tube 15 and an opening 18 in the submarine hull 17. The torpedo tube 15 and the submarine hull 17 are shown only in section. Shutterway 10 would typically be made from welded metal or molded plastic depending upon weight and strength considerations.

Shutterway 10 is capable of being in any one of three positions. In a first position as shown in FIG. 1, a cylindrical passageway 20 connects the muzzleward end 13 of torpedo tube 15 to the opening 18 in the submarine hull 17. In this position, a centerline axis 19 of tube 15 is aligned with a line of axis 21 of passageway 20. The line of axis 21 passes through center 11 of the shutterway 10.

Figure 2:
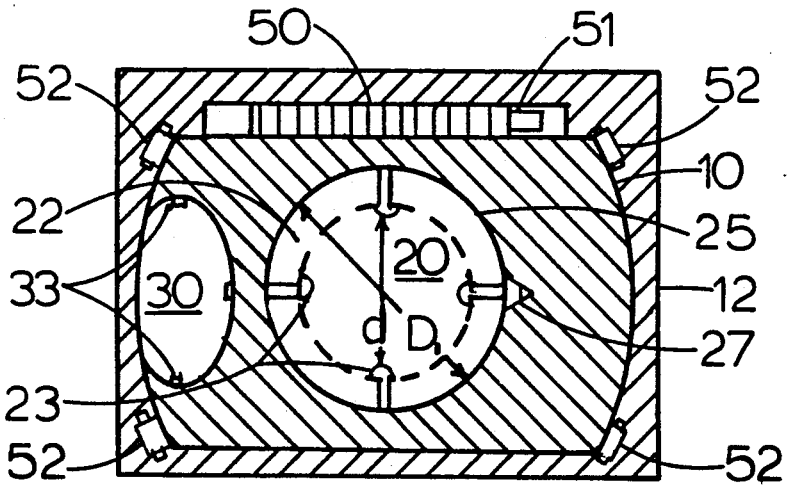
FIG. 2 is an elevation-view of the torpedo tube shutterway viewed from the shutterway position that permits a swimout launch.

Referring now to FIG. 2, an elevation-view of shutterway 10 is shown as viewed from the position that permits a swimout launch. Guide rails 23 are provided along the sides 25 of passageway 20 to form a cross-sectional area of diameter d. Diameter d is chosen to guide a torpedo (not shown), also having a diameter d, through shutterway 10. The diameter $D_1$ of passageway 20 is chosen such that a flow area 22 is created in the space between diameter $D_1$ of passageway 20 and diameter d of the torpedo. Flow area 22 is necessary to allow water to flow freely to the torpedo's propellers during a swimout launch. A swimout launch is one that relies on propulsion generated by the torpedo's propellers to expel itself from torpedo tube 15. Typically, for a torpedo having a 21 inch diameter, diameter $D_1$ of passageway 20 would be 31 inches. A conventional tube 15 is capable of adjusting its diameter to one of either a swimout or ejection launch mode. In the case of the swimout launch, the diameter of torpedo tube 15 would be equal to the diameter $D_1$ of passageway 20. A tapered slot 27 is also provided in the side 25 of passageway 20. Tapered slot 27 allows a flexible communication/guidance cable (not shown) which is attached to the torpedo to freely pass through shutterway 10 during a swimout launch.

Figure 3:
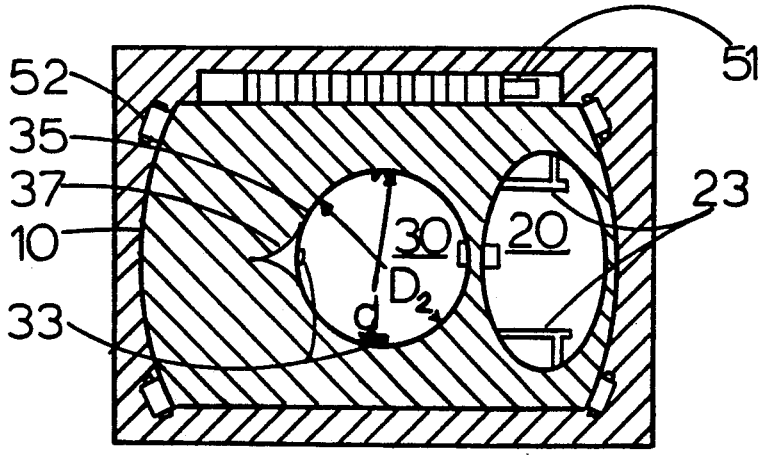
FIG. 3 is an elevation-view of the torpedo tube shutterway viewed from the shutterway position that permits an ejection launch.

A second position of shutterway 10 may be created with the use of a second cylindrical passageway 30 shown in FIG. 1. Passageway 30 has a line of axis 31 passing through the center 11 of shutterway 10. Line of axis 31 is oriented at an angle of 60° with respect to the line of axis 21. Thus, if shutterway 10 shown as positioned in FIG. 1 were rotated 60° counterclockwise, the elevation-view of the shutterway 10 would be in position for an ejection launch as shown in FIG. 3. In this ejection launch position, line of axis 31 would be aligned with the centerline axis 19 of tube 15.

Guide rails 33 are provided along sides 35 of passageway 30. Guide rails 33 form diameter d that guide the torpedo of diameter d through the shutterway 10. The diameter $D_2$ of passageway 30 is only slightly larger than the diameter of the torpedo. This is because the ejection launch relies purely upon the ejection plume from the aft end of the torpedo to push the torpedo through the shutterway 10. Accordingly, passageway 30 must not permit the ejection plume to bypass the torpedo. In the ideal case, diameter $D_2$ of passageway 30 would be exactly equal to the diameter d of the torpedo and no guide rails 33 would be required. However, practical and cost considerations make such exact machining prohibitive. Accordingly, the diameter $D_2$ of passageway 30 is typically 22.5 inches for a 21 inch torpedo. Constriction of the ejection plume is accomplished by staggering a number of guide rails 33 along the sides 35 of passageway 30 to effectively create a flow area having a diameter d to thereby constrain the ejection plume. Similar to the tapered slot 27 of passageway 20, a tapered slot 37 is provided in passageway 30 to allow the flexible communication/guidance cable attached to the torpedo to freely pass through the shutterway 10 during an ejection launch.

A third position of shutterway 10 will close off the muzzleward end 13 of tube 15 and opening 18 of submarine hull 17 with a contoured surface 40. Contoured surface 40 has a line of axis 41 passing through the center 11 of shutterway 10. Line of axis 41 is oriented at an angle of 60° with respect to line of axis 31 and 60° with respect to line of axis 21. Thus, if shutterway 10, shown as positioned in FIG. 1, were rotated clockwise by 60°, contoured surface 40 would close off both the muzzleward end 13 of tube 15 and opening 18 of submarine hull 17. Contoured surface 40 is coated with the same acoustic absorbing material as the submarine hull 17.

Rotation of shutterway 10 around its center 11 might be accomplished through the use of ring gear 50 and a rotary power shaft 51. Alternatively, the power shaft/ring gear arrangement could be replaced by a link and arm arrangement. To facilitate the rotation of shutterway 10, roller bearings 52 are placed inside the housing 12 to make contact with the perimeter of shutterway 10. Alternatively, roller bearings 52 might be replaced with non-metallic glide strips.

The advantages of the present invention are numerous. The three-position torpedo shutterway of the present invention accommodates both the swimout and ejection launch modes in its first and second positions, respectively. In addition, the third position of the shutterway acoustically seals the opening in the hull following either the swimout or ejection launch.

Thus, it will be understood that various additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A shutterway for a torpedo tube, said torpedo tube housing a torpedo of diameter d and having a centerline axis and an exit flow area, said shutterway comprising:

a means for creating a first passageway through said shutterway, said first passageway means having a flow area of diameter D and a line of axis passing through a center of said shutterway, wherein $D>d$ when said first passageway line of axis is aligned with said torpedo tube center line axis;

a means for creating a second passageway through said shutterway, said second passageway means having a flow area of diameter d and a line of axis passing through said center of said shutterway, said second passageway line of axis oriented at an angle of 60° with respect to said first passageway line of axis, wherein said second passageway flow area of diameter d is equal to said torpedo tube diameter when said second passageway line of axis is aligned with said torpedo tube centerline axis; and a means for closing off said torpedo tube exit flow area, said closing means having a line of axis passing through said center of said shutterway and oriented at an angle of 60° with respect to said first passageway line of axis and at an angle of 60° with respect to said second passageway line of axis, wherein said torpedo tube exit flow area is closed off when said closing means line of axis is aligned with said torpedo tube centerline axis.

2. A shutterway according to claim 1, said first passageway means further comprising a plurality of guide rails mounted on the sides thereof for guiding the torpedo through said first passageway means.

3. A shutterway according to claim 1, said second passageway means further comprising a plurality of guide rails mounted on the sides thereof for creating said second passageway flow area and for guiding the torpedo through said second passageway means.

4. A shutterway according to claim 1 wherein said closing means comprises an acoustic absorbing material.

5. A rotary shutterway apparatus for a submarine torpedo launch system, said apparatus residing within a housing between the muzzleward end of the torpedo tube and an opening in the submarine hull, said apparatus comprising:

a three-position shutterway, wherein a first shutterway position provides a first passageway between the muzzleward end of the torpedo tube and the opening in the submarine hull that permits the launch system to function in a swimout launch mode, a second shutterway position provides a second passageway between the muzzleward end of the torpedo tube and the opening in the submarine hull that permits the launch system to function in an ejection launch mode and a third shutterway position that seals both the muzzleward end of the torpedo tube and the opening in the submarine hull, wherein each of said three positions has a line of axis passing through a center of said shutterway; and a means for rotating said three-position shutterway around said center of said shutterway to one of its three positions.

6. An apparatus according to claim 5 wherein said first, second and third shutterway position line of axes are oriented at angles of 60° with respect to one another.

7. An apparatus according to claim 5 wherein said shutterway comprises an acoustic absorbing material at said third position.

8. An apparatus according to claim 5 wherein said rotating means comprises:

a ring gear mechanically connected to said shutterway; and a power shaft in mechanical communication with said ring gear.

9. A rotary shutterway for controlling the flow area through said shutterway, comprising:

a means for creating a first passageway that provides a maximum flow area through said shutterway, said first passageway having a line of axis passing through a center of said shutterway;

a means for creating a second passageway that provides a constrained flow area through said shutterway, said constrained flow area being less than said maximum flow area, said second passageway having a line of axis passing through said center of said shutterway and oriented at an angle of 60° with respect to said first passageway line of axis; and a means for closing off the flow area through said shutterway, said closing means having a line of axis passing through said center of said shutterway and oriented at an angle of 60° with respect to said first passageway line of axis and at an angle of 60° with respect to said second passageway line of axis, whereby said shutterway is rotated about said center of said shutterway.

* * * * *